United States Patent [19]

Smith

[11] Patent Number: 5,020,244

[45] Date of Patent: Jun. 4, 1991

[54] METHOD AND APPARATUS FOR DRYING LIQUID ON PRINTED MEDIA

[75] Inventor: Normand C. Smith, Versailles, Ky.

[73] Assignee: International Business Machines Corporation, Armonk, N.Y.

[21] Appl. No.: 444,262

[22] Filed: Dec. 1, 1989

[51] Int. Cl.[5] ..... F26B 13/00

[52] U.S. Cl. ..... 34/155; 34/160

[58] Field of Search ..... 34/151, 155, 156, 41

[56] References Cited

U.S. PATENT DOCUMENTS 4,538,899 9/1985 Landa et al. ..... 34/155 X 4,944,673 7/1990 Jacobs et al. ..... 34/155 X

*Primary Examiner*—Henry A. Bennett

*Attorney, Agent, or Firm*—J. R. Hanway

[57] ABSTRACT

An apparatus is employed for drying liquid, preferably ink, on a medium, which entails heating air and blowing it across the surface of the medium at high velocity. The heated air is recaptured and recirculated resulting in lower energy usage for heating and a reduced relative humidity of drying air to enhance drying. Various structural configurations are disclosed but each has a common feature of creating an air dam at the point of entry of a medium along a media path and at the exit point. The use of a baffle adjacent to the medium path acts as a deflector for the heated air to distribute it across the medium surface at high velocity and also creates ports for expressing and recirculating heated air.

12 Claims, 3 Drawing Sheets

METHOD AND APPARATUS FOR DRYING LIQUID ON PRINTED MEDIA

BACKGROUND OF THE INVENTION

Smudging is a problem in printing where wet ink is deposited on a medium. To overcome this problem, heated air has been used to accelerate ink drying. In the course of developing this invention it has been found that there are three factor's which control the rate of drying of a liquid deposited upon a medium, when heated air is blown across the medium surface. They are (1) the velocity of the air relative to the medium surface, (2) the temperature of the air, and (3) the relative humidity of the air. None of the earlier teachings have effectively addresses all three factors in their attempts to accelerate drying times. Each has addressed only one or two of these factors, but not all three effectively.

Previous solutions have aided drying by passing heated air over the print media. One example of this technique is taught in U.S. Pat. No. 4,340,893 by Ort, in which heated air is supplied through ports adjacent to the print head at the time of printing. In Ort, air flow must be regulated to avoid interaction with a stream of ink droplets. In another art, that of coating absorbent surfaces, U.S. Pat. No. 2,320,513 by Drummond, teaches drying of a liquid coating by passing a medium coated with liquid through a chamber in which heated air is directed onto the medium to dry the surface. It would appear from the disclosure that there is a recirculation of heated air within this chamber.

Two other U.S. Pat. Nos. 4,714,427 by Tsuruoka et al. and 4,720,727 by Yoshida, teach using heated air blown against an image surface to dry an image created on a medium surface. In each teaching, heated air is blown over a surface area without recirculation or control of velocity across a medium's surface.

SUMMARY OF THE INVENTION

This invention teaches an enhanced drying apparatus and method in which the three factors, air velocity relative to a medium surface, temperature of the blown air, and the relative humidity of the blown air, are optimized. This is accomplished by use of a fan constructed of a cylinder rotatably mounted within a housing with impeller blades mounted around the outer circumference of the cylinder. A housing encloses the fan to create an air chamber and air is drawn into the chamber from a thin cavity created over a media path by a shroud. This air has previously been heated by a heating element arranged either along the media path or within the housing. Air dams are created at the entrance and the exit points of the cavity formed by the media path and a baffle mounted within the housing and an extended shroud attached to the housing. This baffle directs the heated air onto the media at high velocity. The reheated air has a lower relative humidity than newly heated ambient air and reheating lowers the amount of energy needed to heat the blown air.

Accordingly, it is an object of this invention to provide an apparatus for accelerated drying of a liquid on a medium by supplying high velocity heated air across the surface of a medium.

It is another objective of this invention to provide an apparatus that reduces the relative humidity of heated blown air across the surface of a medium for drying liquid thereon.

It is yet another objective of this invention to reduce the amount of energy used to heat air blown across the surface of a medium for drying liquid thereon.

DESCRIPTION OF THE PREFERRED EMBODIMENT

Figure 1:
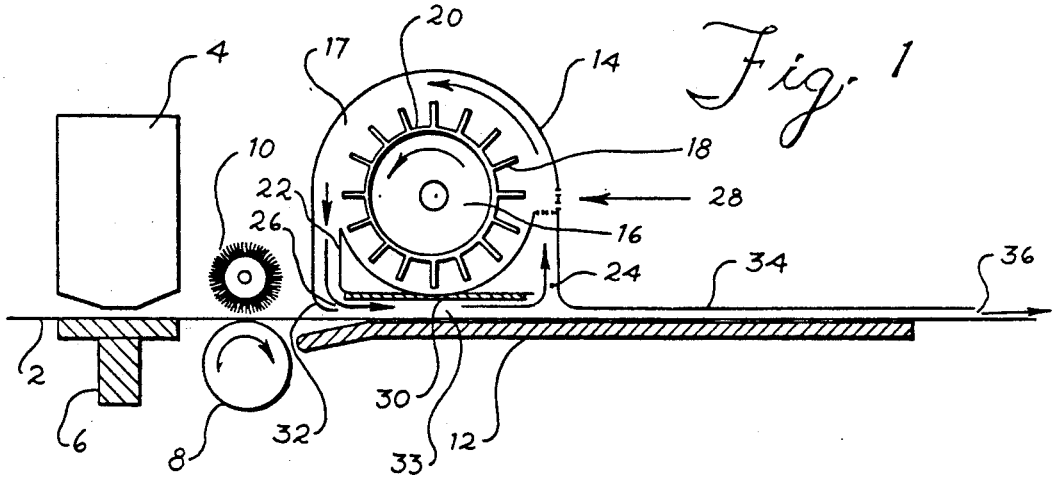
FIG. 1, shows a blower and heater combination acting on a media path.

Referring to FIG. 1, a media 2, has ink deposited on it by print head 4, reacting against a platen 6. A drive roller 8, acts on the media 2 by rotational force to advance the media which has pressure applied to it by star wheel 10 to maintain frictional contact with the drive roller 8. A guide 12, receives the media 2, as it is advanced away from the printing action where wet ink has been applied. At this stage the ink has not yet set. It is within the scope of this invention that other liquids may be deposited on a media 2, to be acted upon, by the drying process which is now being disclosed.

Further, in FIG. 1, there is shown a housing 14, that is partially open toward and adjacent to the guide 12, on which the media 2 is advanced. The housing may be of may different shapes, but in the embodiment shown, it is a thin tunnel shape with its length perpendicular to the path of the media 2. Mounted within the housing 14, is a fan 16. The positioning of the fan 16 and the housing 14 creates a chamber 17. The fan 16 is rotatably mounted within the housing 14, in axial alignment with the axis of the tunnel shaped housing 14. The fan 16 is a cross-flow fan with impellers 18 mounted on the outer cylindrical circumference 20 of the fan 16. Mounted within the housing 14, between the fan 16 and the guide 12 is a baffle 22. The baffle 22 serves two purposes. Its position between the fan 16 and the guide 12 creates two openings, the first opening 24 for drawing regulated air into chamber 17 by the rotational action of the fan 16 and the second opening 26 expels air from the chamber 17. Air holes 28 in the housing 14 allow ambient air to enter the chamber 17 at a regulated rate.

A heating element 30, as shown in FIG. 1, is affixed to the baffle 22, between it and the guide 12. As air is forced through the second opening 26, it is directed by the housing wall 32 to a thin gap 33 between the baffle 22 and the guide 12. Preferably, this air is supplied at high velocity which aids in the drying of ink on the media 2. In the path of this air stream is the heating element 30, which heats the air blown onto the media 2. The first opening 24, created by the baffle 22 and the housing 14, partially draws this air stream back into the chamber 17, by the action of fan 16. A shroud 34, extends from housing 14, generally parallel to the guide 12 and away from the housing 14 in the direction of media flow from left to right. The heated air blown across the media 2, that is not drawn back into the chamber 17, by fan 16, at the first opening 24, is blown down the thin cavity 33 created between shroud 34 and guide 12 and exits at an opening 36. Another function of the high velocity air blown into the cavity 33 is to hold the media 2 against the guide 12 which keeps the wet ink from being smudged by contact with baffle 22 and shroud 34.

The recirculation of heated air shown in FIG. 1, as well as the succeeding figures, is beneficial because the reheated air requires less energy to heat and has a reduced relative humidity as compared to ambient air. The recirculation of heated air increases the equilibrium temperature of the air within cavity 33 in which the media travels, and also slightly raises the specific humidity of the air in the cavity 33, due to the evaporated ink. Except for sustained heavy printing, this does not have enough effect on relative humidity to significantly affect drying time.

To understand the role of humidity in the drying of ink in this invention, it should be kept in mind that when air at 50° F. and 90% relative humidity (R.H.) is heated to 100° F., the new R.H. is 17%. And when air at 90° F. and 90% R.H. is given the same temperature rise, the new R.H. is approximately 19%. A temperature rise of 50–60° F. is easily attainable by having a 15° F. rise in temperature per cycle of air recirculation, which allows venting off 20–25% of the total air circulation. To increase the rise in temperature per cycle, air dams at the openings 26 and 28, where media 2 enters and exits the drying cavity 33, entrap more heated air for recirculation. An approximation of the heat rise from recirculation of heated air is that if half of the heated air is vented off and half recirculated, then the total rise in temperature would be twice that of a single pass heating system. Likewise, venting one-third of the total heated air flow would raise the equilibrium temperature approximately three time that of a single pass, and a one-fourth vent off would raise result in a fourfold increase in the equilibrium temperature of the drying air. This relationship is set forth in the following formula:

$$\Delta t_{ss} = \Delta t_1 \times \frac{t}{e}$$

$\Delta t_{ss}$=steady state temperature increase above atmosphere at fan outlet $\Delta t_1$=temperature increase for one pass with no recirculation $_e$=flow rate of air exiting system with paper output: not recirculated $_t$=total flow rate of air exiting fan, before recirculation; includes recirculation As a consequence, of heated air recirculation, a lower energy source is needed to heat air for drying ink on a media 2 if it is recirculated, than if air is heated and blown onto a wet ink on a media 2 and then vented off into the environment.

Figure 2:
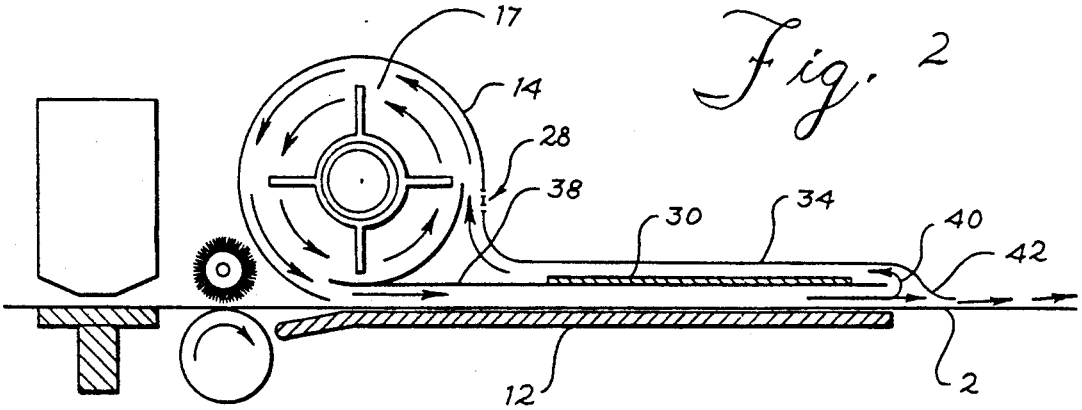
FIG. 2, shows a blower with an extended shroud with a heater element therein acting on a media path.

Shown in FIG. 2 is an alternate embodiment with a rightwardly extended baffle 38 extended from the housing 14 from left to right, between the shroud 34 and the guide 12, to form a recirculation opening 40. A heating element 30 is affixed to baffle 38 between it and shroud 34 to heat air blown across the surface of media 2 as it moves left to right along guide 12. A shroud lip 42 is tapered to reduce the exit path of media 2, which in cooperation with the air drawn back into recirculation at recirculation opening 40, before the media 2 exits the shroud 34, creates an air dam to restrict the escape of heated air. Variations in the shape of shroud lip 42 will vary the exit opening for the media 2 which in turn will regulate the volume of escaping air and in turn the volume of recirculated heated air.

Figure 3:
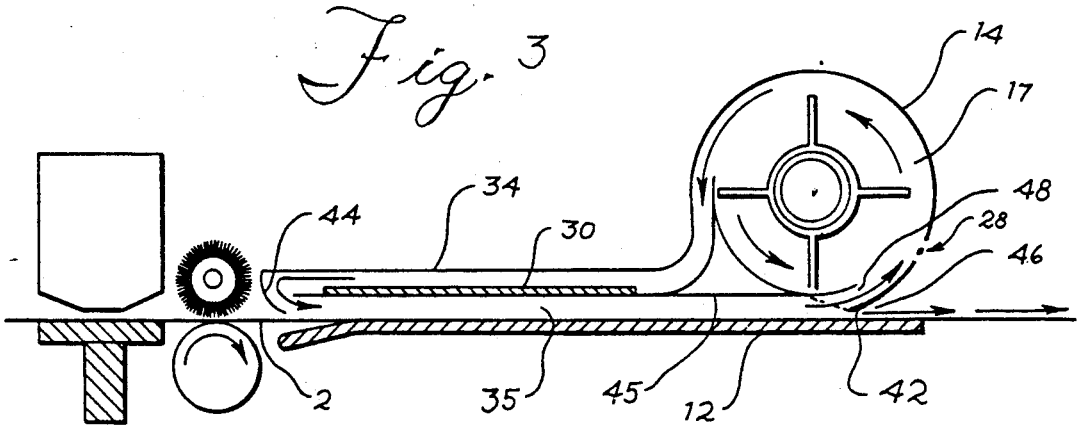
FIG. 3, shows a blower with an extended shroud extended to the left, along a media path, with a heater element within the shroud, for acting on media on the media path, moving from left to right.

FIG. 3 shows an another embodiment where the shroud 34 extends from right to left from a housing 14. In this configuration a shroud lip 44 acts to reverse the direction of air flow and bring it back over the printed media for partial recirculation at air dam 42. In this instance, the media 2 helps form a portion of the drying cavity 35. Again, a heating element 30 is mounted within the shroud 34 and heated air is drawn into the housing 14 to the right of the leftwardly extended baffle 45 where between it and an edge of the housing 14 there is formed an exit opening 46 for the advancing media 2. Just prior to this exit opening, air is drawn into chamber 17 through recirculation opening 48 for recirculation.

Figure 4:
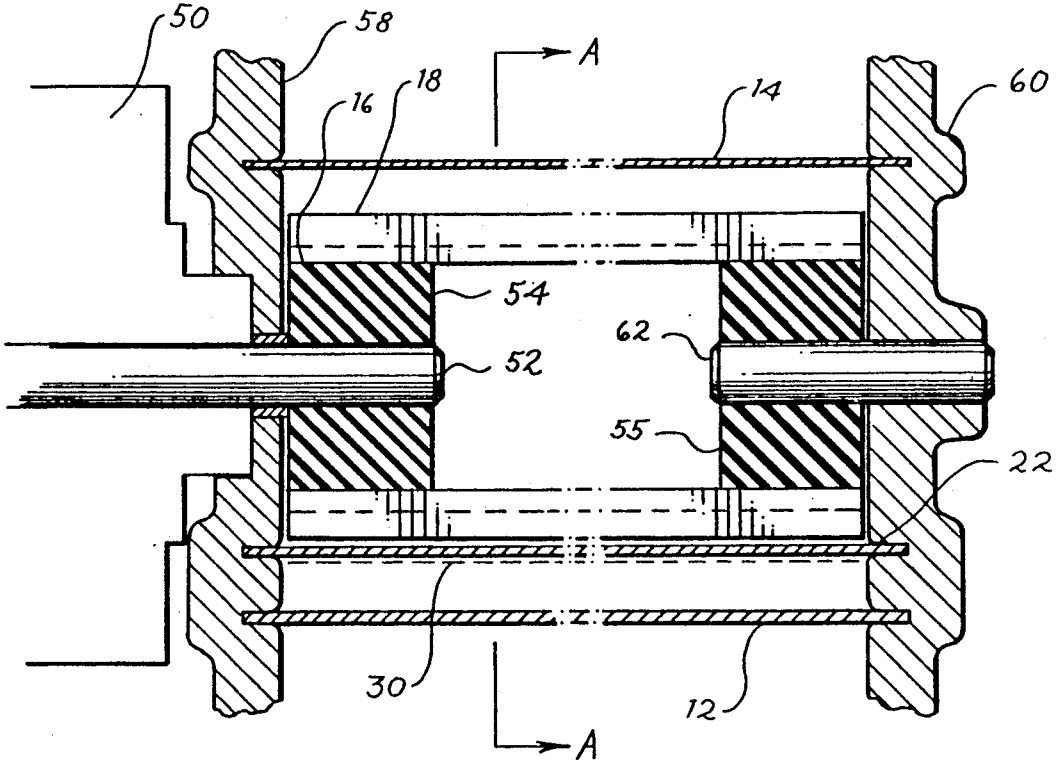
FIG. 4, shows a half section view of a typical blower and heater unit.

FIG. 4 shows a frontal cross section of the fan 16 in housing 14. A motor 50, drives a shaft 52 on which is rotatably mounted in a silicon rubber toroid 54. The silicon rubber toroid 54, is mounted in fan 16 which is made of aluminum or plastic. Other suitable materials may be used as well for the construction of the fan and toroid. The drive shaft 52 is secured to the fan 16 which is mounted between the housing walls 58 and 60. The fan 16 is rotatably attached to a Nylatron toroid 55 which is supported by a bearing shaft 62 stationarily mounted on the housing wall 60 opposite to the housing wall 58 through which the drive shaft 52 is mounted.

Figure 5:
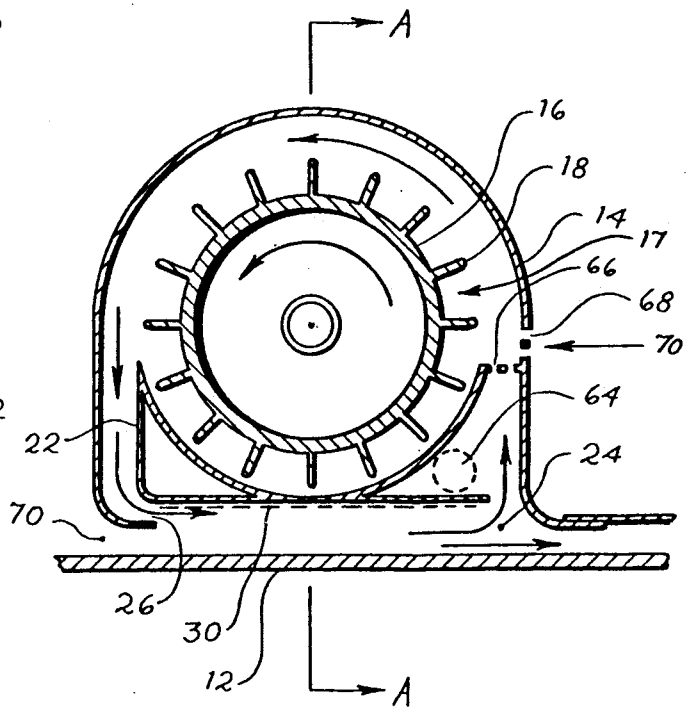
FIG. 5, shows a cross section of a typical blower along the cross section lines A—A.

FIG. 5 shows a cross section of the fan 16 in housing 14 along the section line A-A in FIG. 4. The fan 16 is a cylinder with impellers 18 radiating outwardly. The cylinder of fan 16, along with the inner wall of housing 14 create a chamber 17, into which air is drawn by the rotation of fan 16 at the first opening 24 created by the baffle 22 and the housing 14 wall and exhausted at the second opening 26, into the cavity 33 between the baffle 22 and the guide 12, to dry media that is advanced through this cavity. Some ambient air will be drawn into the chamber 17 through the inlet 70 into which media 2 is advanced. The action of drawing in ambient air, at inlet 70, into the recirculation stream of fan 16, in cavity 33, acts to block heated air from escaping, thereby forming an air dam at inlet 70.

Also shown in FIG. 5 are alternate configurations for arranging the heating elements. In one configuration, a heating element 30 is shown mounted on the baffle between it and the guide 12 in the path of media 2. An alternate configuration is shown in which a heating coil 64 is mounted inside the baffle structure. In fact, a heating element may be mounted at multiple positions within housing 14.

Another feature shown in FIGS. 4 and 5 is the detail for mounting the baffle 22, the housing 14, and the guide 12 onto the housing walls 58 and 60. As can be seen in FIG. 4, the baffle 22, the guide 12, and housing 14, are held between housing walls 58 and 60, by recesses therein. In addition, as shown in FIG. 5, baffle 22 is affixed to the housing 14 by a flange 66 which has ports in it for receiving air drawn into the chamber 17 by the fan 16. Flange 66 acts both as a support and as a means of regulating air flow into the chamber 17.

The recirculation of heated air has been shown to be accomplished by drawing heated air into the chamber 17 for exhausting onto a media 2 in a cavity 33 where the air is again partially drawn back into the chamber 17 for reheating. The amount of air that is reheated and the amount of new air drawn into the chamber for recirculation is a function of the size of the inlet 70 and the amount of air that seeps in through seams in the housing 14. The air drawn into the chamber 17 at the first opening 24 has little ambient air content as a result of the exhausted air stream creating an air dam, which is here directed in the path of the media 2 as indicated by the arrows indicating air flow in FIG. 5. Additional ambient air input may be achieved by an ambient air inlet 68 in the housing 14. Depending on the amount of reheating required, larger or smaller openings may be used to create the desired mix of ambient and reheated air in chamber 17.

Figure 6:
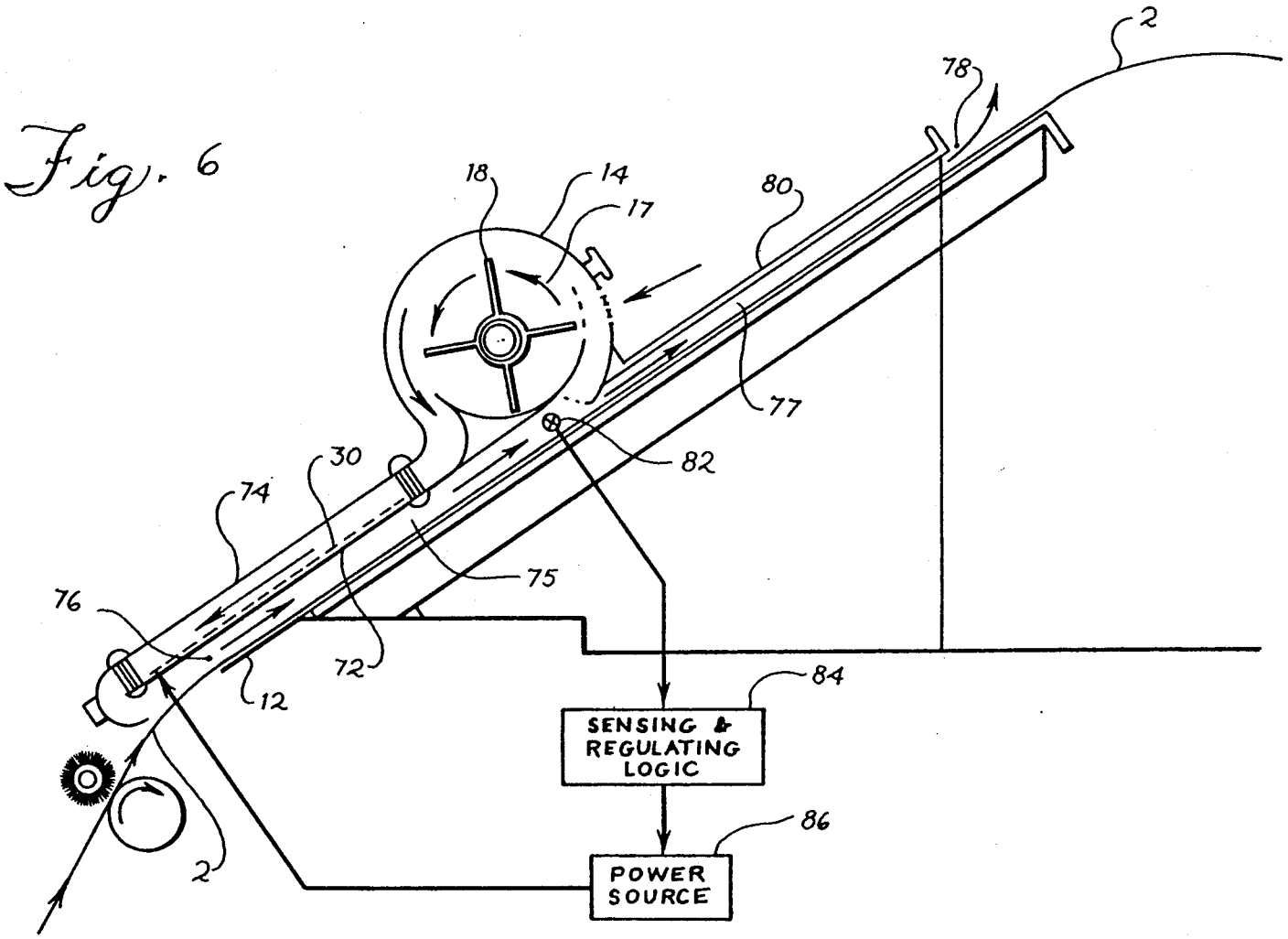
FIG. 6, shows an alternate configuration for the blower heater combination along an inclined media path.

FIG. 6 shows an alternate embodiment with the apparatus tilted along a slanted path. Heating element 30, is mounted on an elongated baffle 72, within extended shroud 74, which in turn is attached to housing 14. Media 2 is drawn in along a paper path and enters the cavity 75 formed by elongated baffle 72 and guide 12 at opening 76. The heated air from the action of heating element 30, is directed onto the media 2 at opening 76 and from thence on down the media's 2 path in cavity 75 where a portion of it is drawn into chamber 17 as has been previously described for recirculation. A portion of the heated air continues down the path of the media 2 in cavity 75 and exits at point 78, which is an outlet formed by a second baffle 80 which in turn, runs generally parallel to guide 12 to form a thin exhaust cavity 77 through which the media 2 passes with heated high velocity air being passed over its surface. This configuration has the advantage of having an extended drying cavity, as can be seen from examination of the drawing. It also demonstrates that the invention may be employed in different elevations other than horizontal.

In each application shown, the drying air is supplied at high velocity. One successful fan 16 configuration which was used to achieve this result uses a long, small diameter fan 16, which extends across the media 2 width. In this configuration, the impeller's 18 diameter was 1.0 inch, and the motor 50, as shown in FIG. 4, is a small shaded pole motor with a shaft 52 speed of 3,000 rpm, which creates an impellar 18 velocity of 780–975 fpm, or 13–16 fps, resulting in air velocities lower than the impellers' 18 tip velocities (approximately 100 fpm, but nonetheless, high drying air velocity.

Also shown in FIG. 6 is a means to regulate the temperature within the drying cavity 75. A thermostat 82 is shown located in the drying cavity 75 which senses the temperature of the recirculated air. A signal from the thermostat 82 is transmitted to a sensing and regulating logic 84, well known to those skilled in the art, which senses the temperature to regulate the power source 86, which in turn appropriately adjust the energy and as a consequence, the temperature of heating element 30. This arrangement allows for a constant monitoring and adjustment of temperature within the drying cavity 75 which results in increased control of the drying factors of relative humidity, and temperature. It is envisioned that a humidity sensor could also be employed with its output used to regulate the heating element temperature to thereby further regulate the relative humidity of the drying chamber.

It will be apparent to those skilled in the art of printer technology that various changes may be made in the structure and arrangement of components therein without departing from the spirit and scope of the invention.

I claim:

1. An apparatus for drying ink on a printed media comprising;

means for advancing a media, having ink deposited thereon, along a media path, a housing having an open portion in proximity to said media path and a separate opening for admitting ambient air, a fixed heating element mounted along said media path for heating air, a fan mounted within said housing and driven by motor means for drawing heated and ambient air into said housing, means for discharging heated air from said housing at high velocity onto said media path, said discharging means including a shroud extending from said housing and being parallel to said media path, thereby defining a thin cavity between said shroud and said media path to direct heated air onto said media, and means for capturing said heated air discharged onto said media path for recirculation by said fan.

2. An apparatus for drying ink on a printed media comprising:

means for advancing a media with ink thereon along a media path, a housing having an open portion adjacent said media path, said housing having an extended portion from said opening to form a shroud along said media path thereby defining a narrow cavity, the end of said shroud forming a narrow opening through which said media exits along said media path, a heating element mounted within said housing, a fan mounted within said housing and driven by motor means for drawing air into said housing for heating and to thereafter discharge the heated air onto said media in said media path, and means for recirculating a portion of the heated air within said housing.

3. An apparatus for drying ink on a printed media as recited in claim 2, wherein said means for recirculating a portion of the heated air further comprises a baffle mounted within said housing to define an opening to receive heated air from said fan and to direct heated air onto said media in said media path, said baffle further terminating at a point within said housing to define a second opening to allow heated air to be drawn back into said said housing by said fan.

4. An apparatus for drying ink on a printed media as recited in claim 3, wherein said heating element is mounted on said baffle between said baffle and said media path.

5. An apparatus for drying ink on a printed media as recited in claim 4, wherein said heating element is a heating coil mounted within said housing.

6. An apparatus for drying liquid on a media comprising:

means for advancing a media having liquid deposited thereon, along a media path, a housing, having an elongated opening, with its length generally perpendicular to the media path and in proximity thereto, a baffle, mounted on said housing in said elongated opening, thereby defining a surface generally parallel to said media path and further defining a first opening and a second opening between said housing and said baffle, a fan mounted within said housing and driven by motor means for drawing air into said housing through said first opening and discharging air through said second opening, means to direct said air onto said media, along said media path, means to heat said air directed onto said media, and means to recirculate said heated air after it is directed onto said media, said air directing means including a shroud extending from said housing adjacent said second opening and along said media path to an end position, thereby defining a thin cavity between said shroud and said media path into which heated air is directed.

7. An apparatus for drying liquid on a media as recited in claim 6, wherein said means to heat air is a heating strip mounted on said baffle between said baffle and said media path.

8. An apparatus for drying liquid on a media as recited in claim 6, wherein said means to heat air is a heating element within said housing.

9. An apparatus for drying liquid on a media as recited in claim 6, wherein said baffle extends from the opening of said housing into said thin cavity created by said shroud and said media path thereby defining said first opening as the space between the end position of said baffle in said cavity and said shroud.

10. An apparatus for drying liquid on a media as recited in claim 9 wherein said means to heat air comprises a heating strip mounted within said shroud, on said baffle.

11. An apparatus for drying liquid on a media according to claims 1, 2 or 6, wherein said fan further comprises a cylinder, axially mounted for rotation within said housing, and having impellar blades mounted on the outer circumference of said cylinder, said cylinder and housing defining a chamber into which air is drawn and discharged by the action of rotation of said impellar blades.

12. An apparatus for drying liquid on a media according to claim 1, 2 or 6, wherein said fan discharges air onto said media at high velocity.

* * * * *